US006666273B2

(12) United States Patent
Laurel

(10) Patent No.: US 6,666,273 B2
(45) Date of Patent: Dec. 23, 2003

(54) VALVE ASSEMBLY FOR USE IN A WELLBORE

(75) Inventor: David F. Laurel, Cypress, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 18 days.

(21) Appl. No.: 10/142,651

(22) Filed: May 10, 2002

(65) Prior Publication Data

US 2003/0209350 A1 Nov. 13, 2003

(51) Int. Cl.[7] ..... E21B 34/10

(52) U.S. Cl. ..... 166/382; 166/320; 166/323; 166/327

(58) Field of Search ..... 166/320, 323, 166/317, 325, 327, 374, 386

(56) References Cited

U.S. PATENT DOCUMENTS 3,385,370 A * 5/1968 Knox ..... 166/317
3,481,397 A * 12/1969 Baker ..... 166/320
4,040,488 A * 8/1977 Nelson ..... 166/317
4,474,241 A * 10/1984 Freeman ..... 166/317
4,729,432 A * 3/1988 Helms ..... 166/317
5,411,049 A 5/1995 Colvard ..... 137/71
5,472,053 A * 12/1995 Sullaway et al. ..... 166/327
5,690,177 A * 11/1997 Budde ..... 166/321
6,547,007 B2 * 4/2003 Szarka et al. ..... 166/317

OTHER PUBLICATIONS

USSN patent application, Ser. No. 09/995,842, filed: Nov. 28, 2001, Applicant(s): Hebert, et al., Entitled: Flow Actuated Valve For Use In A Wellbore.

* cited by examiner

*Primary Examiner*—Hoang Dang
(74) *Attorney, Agent, or Firm*—Moser, Patterson & Sheridan, L.L.P.

(57) ABSTRACT

The present invention generally relates to a plunger-type valve for use in a wellbore. The plunger-type valve is arranged to selectively allow fluid flow to enter and exit the valve in both directions. Subsequently, the plunger-type valve can be deactivated to selectively allow fluid flow in only one direction. The valve includes a body, at least one locking segment, a locking sleeve, at least one biasing member, a valve seat and a plunger.

36 Claims, 6 Drawing Sheets

VALVE ASSEMBLY FOR USE IN A WELLBORE

BACKGROUND OF THE INVENTION

1. Field of the Invention

The present invention relates to a valve assembly for use in a wellbore. More particularly, the invention relates to a valve assembly that allows fluid flow to pass through the valve in either direction. More particularly still, the invention relates to a dual purpose valve assembly for controlling the fluid flow during installation of a casing in a wellbore and subsequently for use as float equipment to facilitate the injection of zonal isolation fluids.

2. Description of the Related Art

Hydrocarbon wells are conventionally formed one section at a time. Typically, a first section of wellbore is drilled in the earth to a predetermined depth. Thereafter, that section is lined with a tubular string, or casing, to prevent cave-in. After the first section of the well is completed, another section of well is drilled and subsequently lined with its own string of tubulars, comprised of casing or liner. Each time a section of wellbore is completed and a section of tubulars is installed in the wellbore, the tubular is typically anchored into the wellbore through the use of a wellbore zonal isolation fluid, like cement. Zonal isolation includes the injection of cement into an annular area formed between the exterior of the tubular string and the borehole in the earth therearound. Zonal isolation protects the integrity of the wellbore and is especially useful to prevent migration of hydrocarbons towards the surface of the well via the annulus.

Zonal isolation methods of string are well known in the art. Typically, the cement fluid is pumped down in the tubular and then forced up the annular area toward the surface. By using a different fluid above a column of the cement, the annulus can be completely filed with cement while the wellbore is substantially free of cement. Any cured cement remaining in the wellbore is drillable and is easily destroyed by subsequent drilling to form the next section of wellbore.

Float shoes and float collars facilitate the cementing of tubular strings in a wellbore. In this specification, a float shoe is a valve-containing apparatus disposed at or near the lower end of the tubular string to be cemented into in a wellbore. A float collar is a valve-containing apparatus that is installed at some predetermined location, typically above a shoe within the tubular string. In certain cases, float collars are required rather than float shoes. However, in this specification, the term float shoe and float collar will be used interchangeably.

The main purpose of a float shoe is to facilitate the passage of cement from the tubular to the annulus of the well while preventing the cement from returning or "u-tubing" back into the tubular due to gravity and fluid density of the liquid zonal isolation fluids. In its most basic form, the float shoe includes a one-way valve permitting fluid to flow in one direction through the valve, but preventing fluid from flowing back into the tubular from the opposite direction. The float shoes usually include a cone-shaped nose to prevent binding of the tubular string during run-in.

Typically, wellbores are full of fluid to protect the drilled formation of the borehole and aid in carrying out cuttings created by a drill bit. When a new string of tubulars is inserted into the wellbore, the tubulars must necessarily be filled with fluid to avoid buoyancy and equalize pressures between the inside and the outside of the tubular. For these reasons, a float shoe should have the capability to temporarily permit fluid to flow inwards from the wellbore as the tubular string is run into the wellbore and fills the tubular string with fluid. In one simple example, a springloaded, normally closed, one-way valve in a float shoe is temporarily propped in an open position during run-in of the tubular by a drillable object, which is thereafter destroyed and no longer affects the operation of the valve.

Other, more sophisticated solutions have been the use of a differential fill valve. The differential fill valve allows filling of the tubular and circulation by utilizing the differential pressure between the inner and the outer annulus of the tubular. Typically, the prior art differential fill valve comprises a first and second flapper valve and a sleeve. The flapper valves are bias closed by a spring. The sleeve is secured in place by shear pins and is shiftable from a first to a second position. In operation, the differential fill valve is disposed on the end of the first string of tubular then inserted into the wellbore. During run-in the sleeve is in the first position, which prevents the second flapper valve from operating. As subsequent strings of tubulars are inserted into the wellbore the first flapper valve in the differential flow valve opens and closes based upon the differential pressure, thereby allowing wellbore fluid to enter the tubular string. The volume of wellbore fluid entering the tubular string is predetermined to achieve a differential height between the wellbore fluid inside the tubular annulus and the wellbore fluid outside the tubular. The amount of fluid entering the tubular through the flapper valve is controlled by a spring selected to bias the first flapper valve closed. The process of allowing a predetermined volume to enter the tubular is what is commonly called in the industry as differentially filling the tubular.

After the entire string of tubulars is disposed downhole, the differential fill capability of the valve is deactivated to change the valve into a one-way check valve. Typically, deactivation is accomplished by dropping a weighted ball from the surface down the wellbore either by free-fall or pumped in by a fluid mechanism allowing the ball to land into the sleeve. At a predetermined pressure the pins that secure the sleeve in the first position shear and the sleeve is shifted axially downward to a second position. In the second position, the sleeve closes the first flapper valve and subsequently allows the second flapper valve to operate. The deactivated differential fill valve functions as a standard float valve as described in the above paragraphs.

There are several problems associated with the prior art devices. One problem occurs while dropping the weighted ball to deactivate the differential fill feature in a deviated wellbore (deviations greater than 30 degrees from vertical). Typically, the ball is allowed to drop free-fall or pumped into a ball seat located in a sleeve. After the ball lands in the ball seat, drilling fluid is pressurized to act against the ball seat to shift the sleeve to a second position, thereby allowing a permanent check valve mechanism to engage. The reliability of actuating balls in a deviated wellbore greater than 30 degrees decreases as the deviation increases. Additionally, actuating balls in a horizontal, or near horizontal (70 to 90 degrees) well become ineffective in performing their required function, which leads to an inoperable downhole tool.

Another problem associated with the prior art devices arises when the tool is no longer needed to facilitate the injection of cement and must be removed from the wellbore. Rather than de-actuate the tool and bring it to the surface of the well, the tool is typically destroyed with a rotating milling or drilling device. Generally, the tool is "drilled up" or reduced to small pieces that are either washed out of the wellbore or simply left at the bottom of the wellbore. As in the case with the prior art devices that comprise of many metallic components numerous trips in and out of the wellbore are required to replace worn out mills or drill bits. This process is time consuming and results in lost productivity time.

Another problem with the prior art devices is the inability to operate in high downhole pressures and temperatures. Typically, as the depth of the wellbore increases both downhole pressure and temperature also increase. The prior art devices having a flapper valve design cannot operate effectively in pressures in excess of 3,000 PSI. Additionally, the prior art devices cannot function properly in downhole temperatures in excess of 300° F.

There is a need for a plunger-type check valve that can operate effectively in deviated wells or nearly horizontal wells. There is a further need for a plunger-type check valve that is made of composite components, thereby minimizing milling operation time upon removal of a valve and subsequently reduce the wear and tear on the drill bit. There is yet a further need for a plunger-type check valve that can operate effectively in high downhole pressures and high temperatures.

SUMMARY OF THE INVENTION

The present invention generally relates to a plunger-type valve for use in a wellbore. In one aspect, the plunger type check valve can operate effectively in deviated or nearly horizontal wells. In another aspect, the plunger-type check valve is made out of composite components, thereby minimizing milling operation time upon removal of a valve and subsequently reduce the wear and tear on the drill bit. In yet another aspect, the plunger-type check valve can operate effectively in high downhole pressures and high temperatures.

The plunger-type valve is arranged to selectively allow fluid to enter and exit the valve in both directions. The invention includes a body, at least one locking segment, a locking sleeve, at least one biasing member, a valve seat, and a plunger. In one direction, fluid enters an upper end of the body of the valve and urges the plunger downward, thereby allowing the fluid to exit the bottom of the valve body. In another direction, fluid enters the bottom of the valve body and urges the seat upwards, thereby allowing the fluid to flow to the upper end of the valve body.

In another aspect, the plunger-type valve may be deactivated to selectively allow fluid to flow in only one direction. At a predetermined maximum flow rate, the locking sleeve and the valve seat is urged axially downward. The locking segment moves radially inward to secure the locking sleeve in a fixed position. In turn, the valve seat moves axially downward to a predetermined point in the body. In this manner, both the locking sleeve and valve seat are restricted from axial movement. Consequently, fluid may only enter the top of the valve body and exit the bottom of the valve body by urging the plunger downward.

BRIEF DESCRIPTION OF THE DRAWINGS

So that the manner in which the above recited features and advantages of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
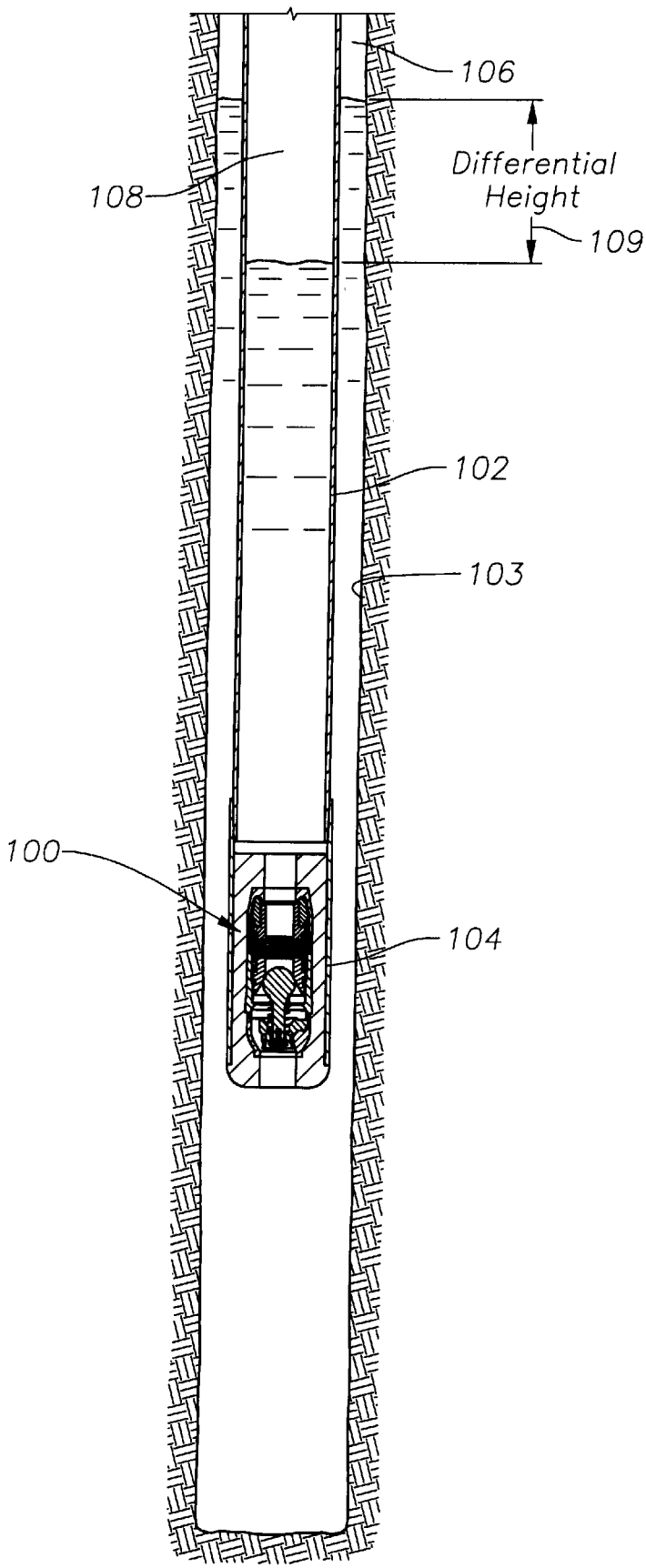
FIG. 1 is a longitudinal cross-sectional view of one embodiment of a valve assembly at an end of a tubular in accordance with the present invention.

FIG. 1 is a longitudinal cross-sectional view of one embodiment of the valve assembly 100 at an end of a tubular 102 in accordance with the present invention. As illustrated, the valve assembly 100 is disposed in a float shoe housing 104. It should be noted that the valve assembly 100 may also be used in a float collar arrangement, or any other configuration in which a plunger-type check valve is required in a downhole tool.

Typically, the wellbore 103 contains wellbore fluid that has accumulated during the drilling operation. As the tubular 102 is inserted in the wellbore 103, the fluid is displaced into an annulus 106 created between wellbore 103 and the tubular 102. As it is lowered into the wellbore, the tubular 102 encounters a buoyancy force that impedes its downward movement. The force increases as the tubular is lowered further. At a predetermined differential pressure between the pressure exerted against the tubular and the internal pressure of the tubular, the valve assembly 100 allows wellbore fluid to enter an interior 108 of the tubular 102 to relieve the buoyancy forces acting on the tubular 102. The amount of wellbore fluid entering the tubular interior 108 is determined by a pre-selected differential height 109 between the wellbore fluid in the tubular interior 108 and the wellbore fluid in the annulus 106. The differential height 109 is density dependant, therefore, the heavier the fluid the smaller the differential height 109 and the lighter the fluid the larger the differential height 109. The valve assembly 100 will differentially fill the tubular 102 by cycling between open and close to maintain the pre-selected differential height 109.

Figure 2:
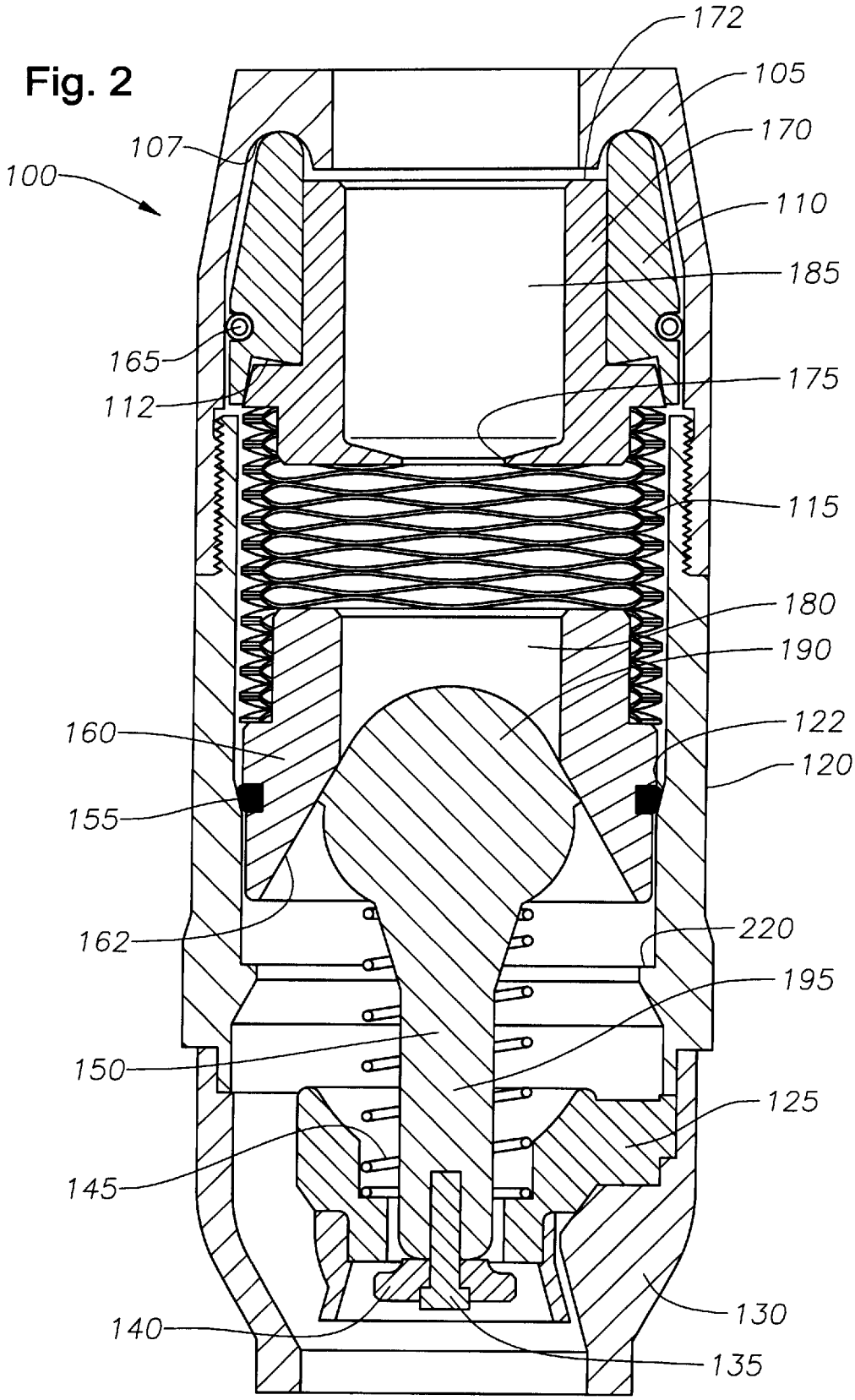
FIG. 2 is an enlarged cross-sectional view of the valve assembly in FIG. 1.

FIG. 2 is an enlarged cross-sectional view of the valve assembly 100 of FIG. 1. The assembly 100 includes an upper housing 105 that is threadedly connected to a lower housing 120. A retaining housing 130 is connected to the lower housing 120 at the lower end of the valve assembly 100. The valve assembly 100 further includes a plurality of segments 110 radially spaced apart in the upper housing 105. The upper end of the segment 110 is captured in a groove 107 in the upper housing 105. The groove 107 is constructed to act as a pivot point for the segments 110. A biasing member 165 is disposed at the lower end of each segment 110 to provide a means for locking the segments 110 in one position. Preferably, the biasing member 165 is a spring device wrapped radially around segments 110 to bias the segments 110 inward. Although the biasing member 165 is illustrated as an O-ring, it should be noted that the biasing member may include a garter spring, a series of C-rings, or any other device that produces a radial force. A locking shoulder 112 is formed at the lower end of the segment 110.

A locking sleeve 170 may be disposed inside the segments 110 in the upper housing 105. The locking sleeve 170 is axially movable between a first position and a lock position and contains a passageway 185 that fluidly connects to a passageway 180 in a valve seat 160. A surface 172 is provided at the upper end of the locking sleeve 170 that is later used to secure the locking sleeve 170 in place. At the lower end of the locking sleeve 170 is an orifice 175. The orifice 175 has a smaller inside diameter than the inside diameter of passageway 185. As fluid flows through the passageway 185 and enters the orifice 175, a differential pressure is created due to the restricted flow through the smaller inside diameter of the orifice 175. This differential pressure provides a force required to axially translate the locking sleeve 170 downward. The inside diameter of the orifice 175 is based on the fluid density and flow rate through the orifice 175.

At the lower end of the locking sleeve 170 are sleeve biasing members 115. The sleeve biasing members 115 are disposed between the locking sleeve 170 and the valve seat 160. In the preferred embodiment, the sleeve biasing members 115 are a plurality of disk shaped members such as wave springs or wave washers. However, a sealed volume of compressible fluid/gas or semi-solid compressible material such as an electrometric material, composite or plastic may be employed, so long as it is capable of biasing the locking sleeve 170. In the preferred embodiment, the sleeve biasing members 115 are an annular member that bias the valve seat 160 and the locking sleeve 170 in opposite directions. Additionally, the sleeve biasing members 115 provide the biasing force (or backpressure force) against the valve seat 160 to control the amount of wellbore fluid entering the valve assembly 100 while differentially filling the tubular (not shown) to maintain a pre-selected differential height. The size and thickness of the sleeve biasing members 115 are selected based upon the desired differential height and the quantity of sleeve biasing members 115 is based upon the desired stroke length of the valve seat 160.

The valve seat 160 is an annular member that includes passageway 180 at the upper end and an outwardly tapered portion 162 at the lower end. In FIG. 2, the valve seat 160 is shown in a run-in position. In the run-in position a seal member 155 arranged around the valve seat 160 abuts a shoulder 122 in the lower housing 120. The seal member 155 functions to create a fluid tight seal between the valve seat 160 and the lower housing 120. The value seal 160 may axially move between a retracted and a final extended position inside the lower housing 120. While differentially filling a tubular, the valve seat 160 retracts or moves upward to create a fluid passageway between the bottom of the valve assembly 100 and the passageway 180 in the valve seat 160 thereby permitting fluid to enter tubular 102 (not shown) as illustrated in FIG. 3.

A plunger 150 with a plunger head 190 and a shaft portion 195 is located at the lower end of the valve seat 160. A sealing relationship is created between the plunger head 190 of the plunger 150 and the tapered portion 162 of the valve seat 160. A biasing member in the form of a spring 145 is disposed about the plunger shaft 195 to urge the plunger 150 upward into contact with the valve seat 160 while the sleeve biasing members 115 urge the valve seat downward, thereby creating a sealing relationship. The upper end of the spring 145 is adjacent the plunger head 190 and the lower end of the spring 145 abuts a plunger housing 125. The plunger housing 125 is disposed in the retaining housing 130 at the lower end of the valve assembly 100. A retainer 140 is attached to the lower end of the plunger shaft 195 by a retainer screw 135. In the preferred embodiment, the components of the valve assembly 100 are made out of a drillable, composite material.

Figure 3:
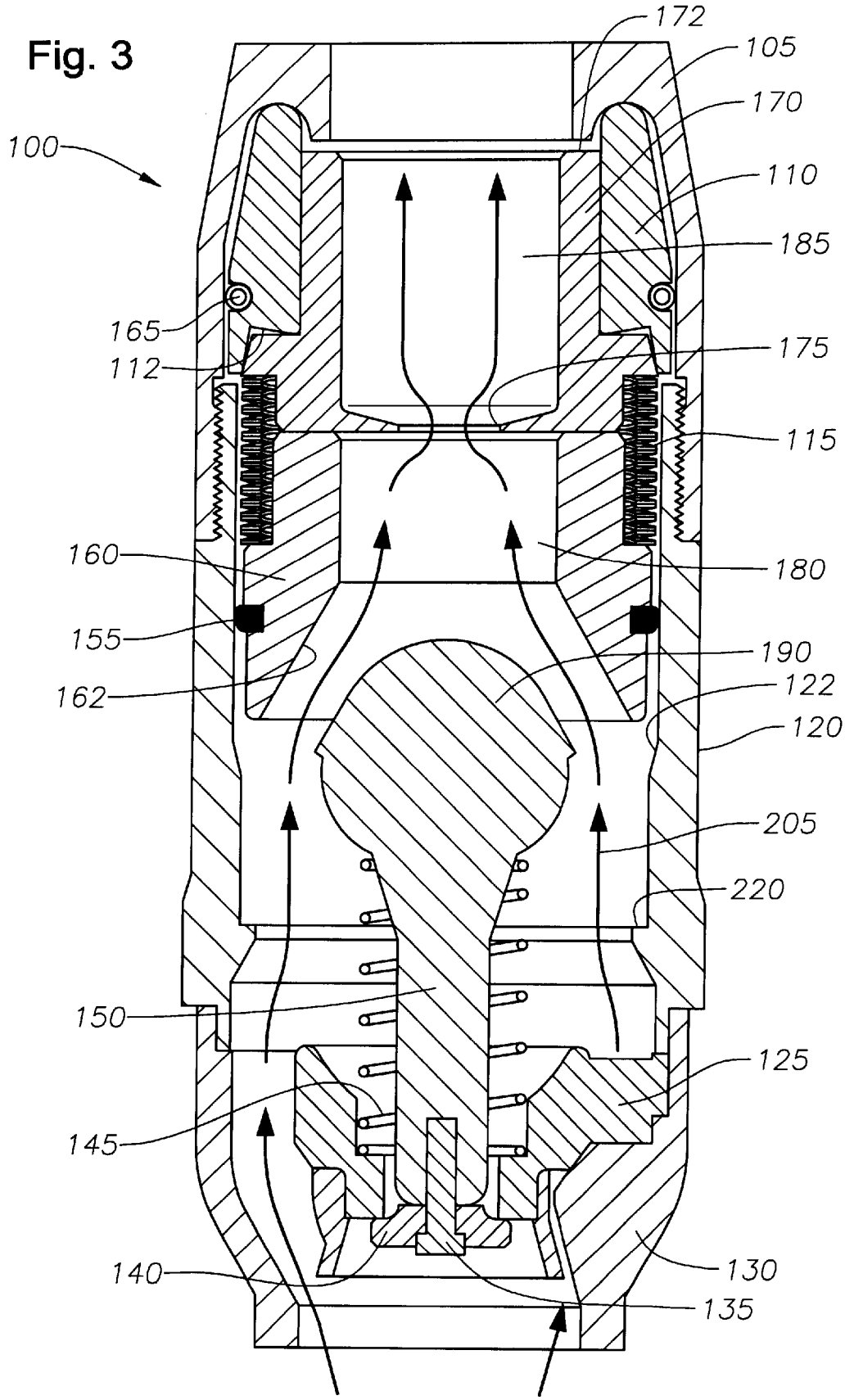
FIG. 3 is a cross-sectional view of the valve assembly as the differential pressure moves the valve seat from the plunger to permit fluid to flow from the lower end to the upper end of the valve assembly.

FIG. 3 is a cross-sectional view of the valve assembly 100 as it is being lowered into the wellbore. In this position, differential pressure resulting from the differential height moves the valve seat 160 away from the plunger 150 to permit fluid to enter from the lower end of the valve assembly 100. During differential filling of the tubular, wellbore fluid enters the lower portion of the valve assembly 100 and acts against the tapered section 162 of the valve seat 160. When the differential pressure overcomes the backpressure created by the sleeve biasing members 115 on the valve seat 160, the sleeve biasing members 115 compress, thereby allowing the valve seat 160 to move axially upward into the retracted position. The upward movement of the valve seat 160 disengages the sealing relationship between the plunger head 190 and the valve seat 160, thereby creating a fluid passageway around the plunger 150. Wellbore fluid, as illustrated by arrows 205, may now enter the lower end of assembly 100, flow around the plunger head 190 into the passageway 180 created in the valve seat 160, move through the orifice 175, and exit the top of the assembly 100 through the passageway 185. As the differential pressure decreases, the sleeve biasing members 115 return to an un-compressed state, thereby allowing the valve seat 160 to sealingly contact the plunger head 190 as illustrated in FIG. 2.

Figure 4:
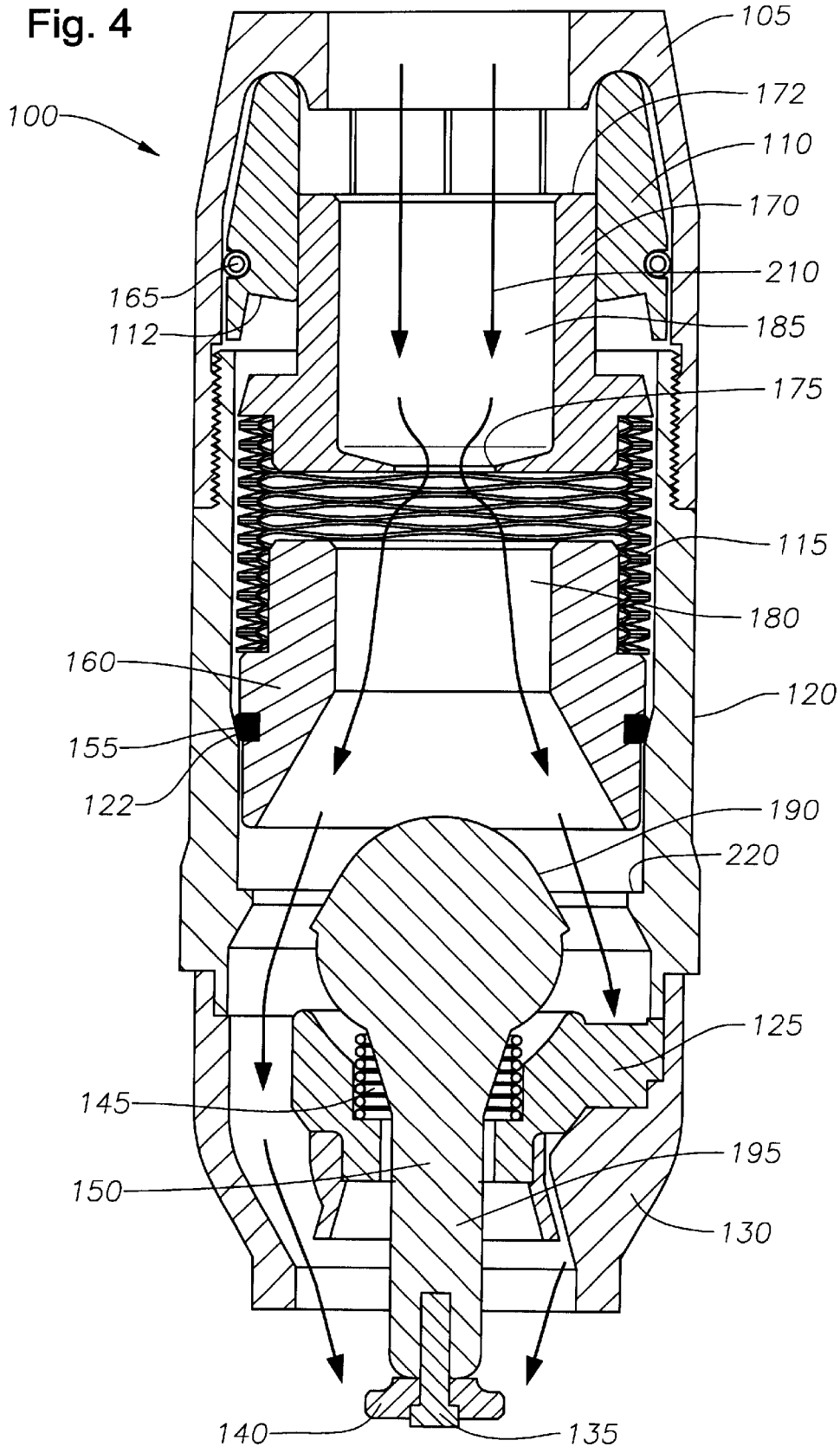
FIG. 4 is a cross-sectional view of a valve assembly pumping fluid through the valve assembly without disengaging the differential fill feature.

FIG. 4 is a cross-sectional view of the valve assembly 100 illustrating the passage of fluid from the tubular, through the assembly and into an annular area between the tubular and a wellborn (not shown). During a completion operation of a well, the wellbore may become clogged with particulates. In this situation, the wellbore needs to be pumped with high pressure fluid to clean out the wellbore prior to inserting another section of tubular. The valve assembly 100 is designed to allow fluid to flow through the valve assembly 100 at a flow rate less than a predetermined maximum flow rate to clean out the wellbore without disengaging the differential fill feature.

In one embodiment, fluid enters the valve assembly 100 at the upper end of the housing 105 as illustrated by arrows 210. As the fluid 210 flows through the passageways 185, 180 it acts against the plunger head 190. When the fluid pressure on the plunger head 190 overcomes the load of the spring 145, the plunger 150 moves downward compressing spring 145 against the plunger housing 125. The movement of the plunger 150 disengages the sealing relationship between the plunger head 190 and the valve seat 160, thereby opening a fluid passageway through the valve 100. As the fluid pressures increases, the locking sleeve 170, sleeve biasing members 115, and the valve seat 160 move axially downward as a unit. As the fluid pressures increases further, the fluid acts on orifice 175 in the locking sleeve 170. The force exerted by the fluid at the orifice 175 urges the locking sleeve 170 axially downward against the sleeve biasing members 115. The force exerted on the locking sleeve 170 does not entirely overcome the biasing force of the sleeve biasing members 115. Thus, the axial movement of locking sleeve 170 only partially exposes segments 110 at the upper end of the locking sleeve 170. In turn, the sleeve biasing members 115 compress and act upon the valve seat 160. The valve seat 160 moves axially downward returning to the run-in position wherein the seal member 155 abuts the shoulder in the housing. Alternatively, the locking sleeve 170 can be secured in the upper housing 105 by a shear pin (not shown), which allows the locking sleeve to be retained in the first position and avoid inadvertent movement of the locking sleeve 170 to the locked position. The shear pin is constructed to fail at a predetermined flow rate acting on the orifice 175, thereby allowing the locking sleeve 170 to move axially downward toward the locked position.

Figure 5:
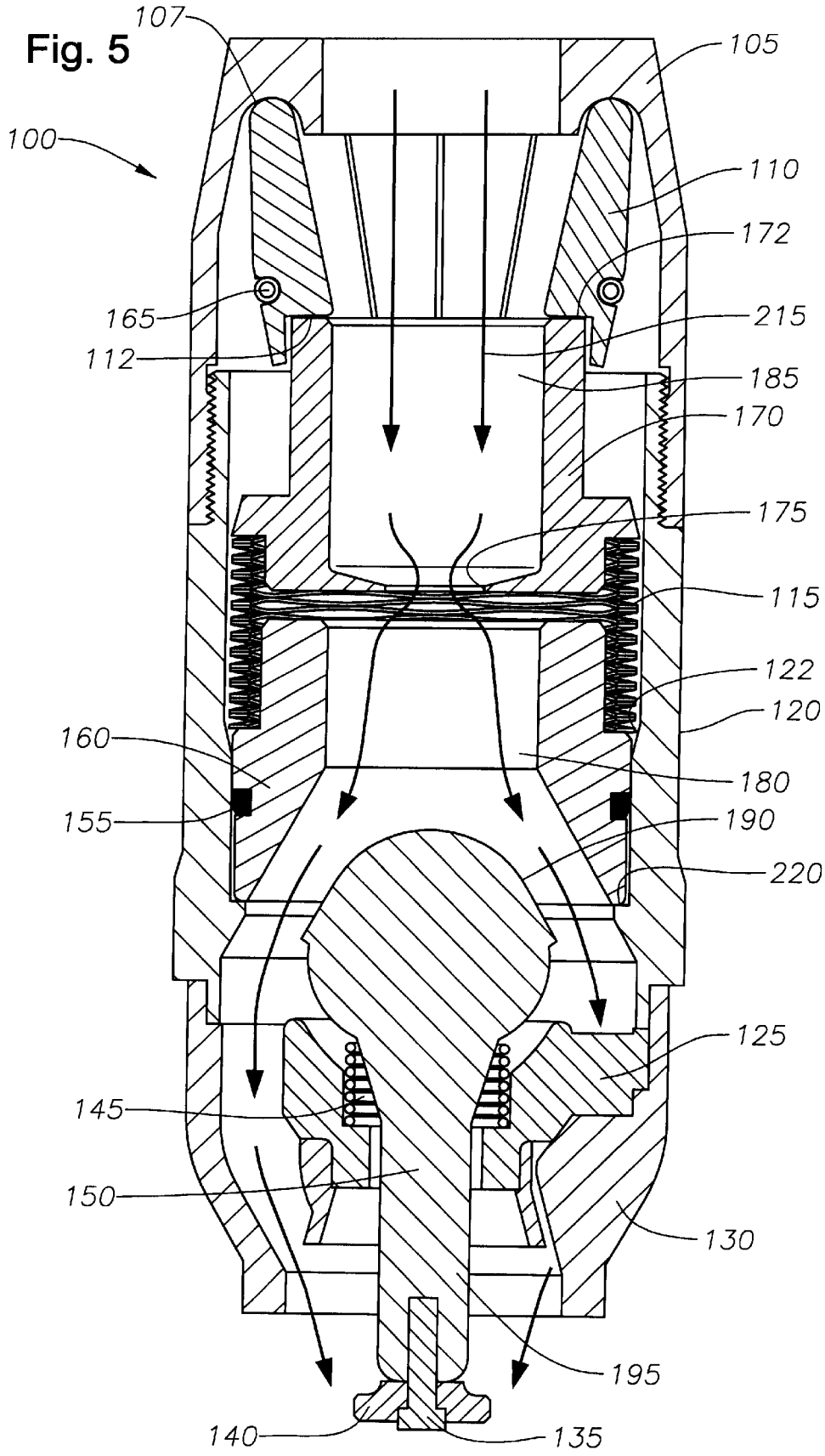
FIG. 5 is a cross-sectional view of the valve assembly pumping fluid at a maximum flow rate to deactivate the differential fill feature.

FIG. 5 is a cross-sectional view of a valve assembly 100 pumping fluid at or above a maximum flow rate to deactivate the differential fill feature. The fluid, as illustrated by arrow 215, initially enters the upper housing 105 in the valve assembly 100. The fluid flows through the passageway 185 and acts upon the orifice 175 and exerts a force that urges the locking sleeve 170 axially downward. At the maximum flow rate, the locking sleeve 170 is urged sufficiently downward to completely expose segments 110. Upon exposure of the segments 110, the biasing member 165 causes the lower end of the segments 110 to move radially inward and the upper end to pivot in the groove 107. As the segments 110 move radially inward the locking shoulder 112 wedges against surface 172 of the locking sleeve 170, thereby preventing the locking sleeve 170 from moving axially upward in the valve assembly 100.

As the locking sleeve 170 moves axially downward, it also compresses the sleeve biasing members 115 against the seat 160. The force on the seat 160 by the sleeve biasing members 115 causes the seat 160 to move axially downward until the bottom of the seat 160 hits a stop 220 in the lower housing 120. The fluid, as illustrated by arrow 215, continues through the passageway 180 and acts upon the plunger head 190 of the plunger 150 thereby causing the plunger 150 to move axially downward. As the plunger 150 moves downward a fluid passageway is created through the valve assembly 100 and the spring 145 is compressed against the plunger housing 125. The fluid flows around the plunger 150 and exits the retainer housing 130. The locking sleeve 170 and the seat 160 are secured in a fixed position by the segments 110 at the upper end of the locking sleeve 170 and the stop 120 at the lower end of the valve seat 160.

Figure 6:
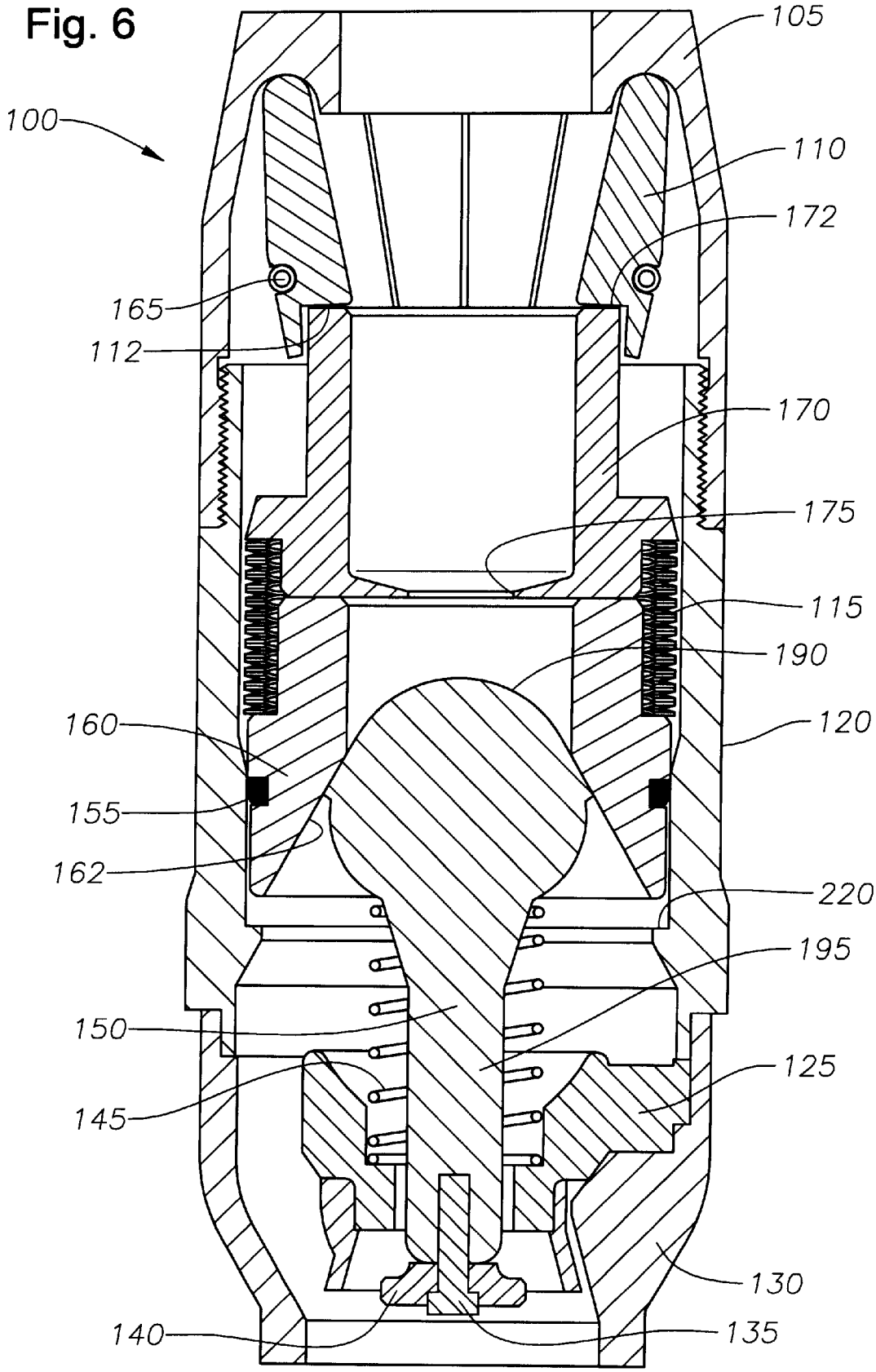
FIG. 6 is a cross-sectional view of a deactivated valve assembly.

FIG. 6 is a cross-sectional view of a deactivated valve assembly 100. As illustrated, the segments 110 are wedged against the locking sleeve 170. The locking sleeve compresses the sleeve biasing members 115 against the valve seat 160, securing the valve seat 160 in a final extended position. While in the final extended position the taper portion 162 of the valve seat 160 creates a sealing relationship with the plunger head 190.

After the section of tubular is installed in the wellbore, the tubular is typically anchored in the wellbore through a cementing process. The valve assembly 100 is used to facilitate the passage of cement from the tubular to the annulus of the well while preventing cement from returning into the tubular due to gravity and fluid density of the cement. The valve assembly 100 acts as a standard one-way check valve allowing fluid to enter the upper housing 105 into the passageway 185 through the orifice 175 into the passageway 180 and act upon the plunger head 190. At a predetermined flow rate, the plunger 150 moves axially downward and compresses the spring 145 disposed around the shaft 195 of the plunger 150. The downward movement of the plunger 150 disengages the seal connection between the plunger head 190 and the valve seat 160 to create a passageway around the plunger 150. The fluid is allowed to flow through the passageway and exit the bottom of the valve assembly 100. After the downward flow is stopped, the plunger 150 moves axially upward due to the force of the spring 145 and the plunger head 190 creates a sealing relationship with seat 160, thereby preventing fluid from returning into the valve assembly 100 from the wellbore.

In another embodiment, a mechanical device, such as a weighted ball (not shown) can be dropped and seated on a ball seat. Pressure application will then slide the locking sleeve 170 to a predetermined distance to deactivate the differential fill feature. In this embodiment, cross-ports are placed above the mechanical device to allow fluid flow pass the device and through the valve.

In operation, the valve assembly 100 is disposed at the lower end of a tubular 102 and then the tubular is run into a wellbore. At a predetermined differential pressure, the valve assembly 100 allows wellbore fluid to enter the tubular. The amount of wellbore fluid allowed to enter the tubular is determined by a pre-selected differential height between the wellbore fluid inside the tubular and the wellbore fluid in the annulus between the tubular and the wellbore. The valve assembly 100 will differentially fill the tubular by cycling between an open and closed position to maintain the pre-selected differential height until the entire section of tubing is disposed in the wellbore.

During differential filling of the tubular, fluid enters the lower portion of the valve assembly 100 and acts against the valve seat 160. Specifically, the differential pressure overcomes the backpressure created by the sleeve biasing members 115 on the valve seat 160, thereby allowing the valve seat 160 to move axially upward into the retracted position. The upward movement of the valve seat 160 disengages the sealing relationship between the plunger head 190 and the valve seat 160. Wellbore fluid may now enter the lower end of assembly 100, flow around the plunger head 190 into the passageway 180 created in the valve seat 160, flow through the orifice 175, and exit the top of the assembly 100 through the passageway 185. As the differential pressure decreases, the sleeve biasing members 115 return to an un-compressed state, thereby allowing the valve seat 160 to sealingly contact the plunger head 190.

During a completion operation of a well, the wellbore may become clogged with particulates. In this situation, the wellbore needs to be pumped with high pressure fluid to clean out the wellbore prior to inserting another section of tubular. The valve assembly 100 is designed to allow fluid to flow through the valve assembly 100 at a flow rate less than a predetermined maximum flow rate to clean out the wellbore. Fluid enters the valve assembly 100 at the upper end of the housing 105. Subsequently, the fluid flows through the passageway 185 and acts against the orifice 175 in the locking sleeve 170. The force exerted by the fluid at the orifice 175 urges the locking sleeve 170 axially downward against the sleeve biasing members 115. The sleeve biasing members 115 compress and act upon the valve seat 160. The valve seat 160 moves axially downward returning to the run-in position. Fluid crossing the orifice enters the passageway 180 it exerts a downward pressure on the plunger head 190. When the fluid pressure on the plunger head overcomes the load of the spring 145, the plunger 150 moves downward. The movement of the plunger 150 disengages the sealing relationship between the plunger head 190 and the valve seat 160, thereby opening a fluid passageway through the valve 100.

Once the section of tubular is completely placed in the wellbore, fluid is pumped at or above a maximum flow rate to deactivate the differential fill feature. The fluid, initially enters the upper housing 105 in the valve assembly 100. The fluid flows through the passageway 185 and acts upon the orifice 175 and exerts a force that urges the locking sleeve 170 axially downward. At the maximum flow rate, the locking sleeve 170 is urged sufficiently downward to completely expose segments 110. Upon exposure of the segments 110, the biasing member 165 causes the lower end of the segments 110 to move radially inward and the upper ends to pivot in the groove 107. As the segments 110 move radially inward the locking shoulder 112 wedges against surface 172 of the locking sleeve 170, thereby preventing the locking sleeve 170 from moving axially upward in the valve assembly 100.

As the locking sleeve 170 moves axially downward it also compress the sleeve biasing members 115 against the seat 160. The force on the seat 160 by the sleeve biasing members 115 causes the seat 160 to move axially downward until the bottom of the seat 160 hits a stop 220 in the lower housing 120. The locking sleeve 170 and the seat 160 are secured in a fixed position by the segments 110 at the upper end of the locking sleeve 170 and the stop 220 at the lower end of the valve seat 160.

After the section of tubular is installed in the wellbore, the tubular is typically anchored in the wellbore through a cementing process. The valve assembly 100 is used to facilitate the passage of cement from the tubular to the annulus of the well while preventing cement from returning into the tubular due to gravity and fluid density of the cement. The valve assembly 100 acts as a standard one-way check valve allowing fluid to enter the upper housing 105 into the passageway 185 through the orifice 175 into the passageway 180 and act upon the plunger head 190. At a predetermined flow rate, the plunger 150 moves axially downward and compresses the spring 145 disposed around the shaft 195 of the plunger 150. The fluid is allowed to flow through the passageway and exit the bottom of the valve assembly 100. After the downward flow is stopped, the plunger 150 moves axially upward and the plunger head 190 creates a sealing relationship with seat 160, thereby preventing fluid from returning into the valve assembly 100 from the wellbore.

While the foregoing is directed to embodiments of the present invention, other and further embodiments of the invention may be devised without departing from the basic scope thereof, and the scope thereof is determined by the claims that follow.

What is claimed is:

1. A valve assembly for use in a wellbore comprising:

a body with an upper end and a lower end;

a valve seat axially movable in the body and biased in a downward direction;

a plunger axially moveable for selectively sealing with the valve seat, the plunger biased in an upward direction; and a locking sleeve movable in the body, the locking sleeve biased in an upward direction and movable between a first position and a locked position;

wherein the valve is constructed and arranged to selectively allow a fluid to enter the upper end of the body and then exit the lower end of the body and to selectively allow the fluid to enter the lower end of the body then exit the upper end of the body.

2. The valve of claim 1, wherein the locking sleeve includes a ball seat.

3. The valve of claim 2, whereby the locking sleeve moves to the locked position after a ball dropped from a surface of the wellbore lands in the ball seat, then pressurized fluid acting upon the ball seat urges the locking sleeve axially downward.

4. The valve of claim 1, wherein the locking sleeve includes an orifice for restricting fluid flow through a bore of the assembly.

5. The valve of claim 4, whereby the locking sleeve moves to the locked position with a predetermined flow of fluid across the orifice.

6. The valve of claim 4, wherein the valve seat comprises an annular member that includes a passageway and a tapered portion on one end of the valve seat.

7. The valve of claim 6, wherein the passageway in the locking sleeve fluidly communicates with the passageway in the valve seat.

8. The valve of claim 6, further including at least one biasing member disposed on a shaft of the plunger to bias the plunger upward into contact with the tapered portion of the valve seat to create a sealing relationship.

9. The valve of claim 1, further including at least one biasing member between the locking sleeve and the valve seat.

10. The valve of claim 9, wherein the at least one biasing member comprises a sealed volume of gas, liquid or combinations thereof.

11. The valve of claim 9, wherein the at least one biasing member comprises a semi-solid compressible material such as a electrometric material, composite, plastic or combinations thereof.

12. The valve of claim 9, wherein the at least one biasing member between the locking sleeve and the valve seat comprises a plurality of disk shaped members.

13. The valve of claim 12, wherein the at least one biasing member comprises wave springs.

14. The valve of claim 1, further including at least one locking segment with a first end and a second end and the body contains a groove to capture the first end of the at least one locking segment.

15. The valve of claim 14, further including a biasing member disposed radially around the second end of the locking segment to inwardly bias the locking segment.

16. The valve of claim 15, wherein the axial movement of the locking sleeve downward in the body causes the second end of the locking segment to move radially inward, thereby securing the locking sleeve in place.

17. The valve of claim 1, wherein the body, plunger, valve seat, and the locking sleeve comprise non-metallic material.

18. The valve of claim 1, wherein the valve is disposable in a tubular in a manner wherein substantially all fluid passing through the tubular must pass through the valve.

19. The valve of claim 1, further including a shear pin to secure the locking sleeve within the body, whereby at a predetermined force the shear pin is sheared allowing the locking sleeve to move in the body.

20. A valve assembly for use in a wellbore comprising:

a body having an upper end and a lower end;

a plunger for selectively allowing fluid flow through the body;

a valve seat, wherein the valve seat is an annular member having a passageway and a tapered portion on one end of the seat;

at least one biasing member for urging the plunger axially in the body;

an annular locking sleeve having a passageway and an orifice for restricting fluid flow, wherein the orifice selectively moves the locking sleeve; and at least one locking segment;

wherein the valve assembly is constructed and arranged to selectively allow a fluid to enter the upper end of the body and then exit the lower end of the body and to selectively allow the fluid to enter the lower end of the body then exit the upper end of the body.

21. The valve of claim 20, wherein the passageway in the locking sleeve fluidly communicates to the passageway in the valve seat.

22. The valve of claim 20, wherein the at least one biasing member urges the plunger axially into contact with the tapered portion of the valve seat to create a sealing relationship.

23. The valve of claim 20, further including a biasing member disposed radially around an end of the locking segment to inwardly bias the locking segment.

24. The valve of claim 23, wherein the downward axial movement of the locking sleeve in the body causes the end of the locking segment to move radially inward, thereby securing the locking sleeve in place.

25. The valve of claim 20, further including at least one biasing member between the locking sleeve and the valve seat.

26. The valve of claim 25, wherein the at least one biasing member comprises a sealed volume of gas, liquid or combinations thereof.

27. The valve of claim 25, wherein the at least one biasing member comprises a semi-solid compressible material such as an electrometric material, composite, plastic or combinations thereof.

28. The valve of claim 25, wherein the at least one biasing member between the locking sleeve and the valve seat comprises a plurality of disk shaped members.

29. The valve of claim 28, wherein the at least one biasing member comprises wave springs.

30. The valve of claim 20, wherein the valve is disposable in a tubular in a manner such that substantially all fluid passing through the tubular must pass through the valve.

31. The valve of claim 20, wherein the body, plunger, valve seat, and the locking sleeve comprise non-metallic material.

32. The valve of claim 20, further including a shear pin to secure the locking sleeve within the body, whereby at a predetermined force the shear pin is sheared allowing the locking sleeve to move in the body.

33. A method for disposing a tubular in a wellbore, comprising;

disposing a valve at the lower end of the tubular, the valve including:

a body with an upper end and a lower end;

a valve seat axially movable in the body;

a plunger for selectively mating with the valve seat;

at least one biasing member for urging the plunger axially in the body;

a locking sleeve axially movable in the body; and at least one locking segment;

running the tubular in the wellbore;

selectively permitting a predetermined amount of fluid to enter and exit the tubular;

deactivating the valve with a predetermined flow rate; and pumping a zonal isolation fluid.

34. The method of claim 33, wherein the valve is constructed and arranged to selectively allow a fluid to enter the upper end of the body and then exit the lower end of the body and to selectively allow the fluid to enter the lower end of the body then exit the upper end of the body.

35. The method of claim 33, wherein deactivating the valve with a predetermined fluid rate includes radially biasing the locking segment to prevent axial movement of the locking sleeve.

36. The method of claim 33, further including the step of shearing a shear pin disposed between the locking sleeve and the body, thereby allowing the locking sleeve to move in the body.

* * * * *